United States Patent [19]

Moscrip

[11] Patent Number: 4,941,627

[45] Date of Patent: Jul. 17, 1990

[54] GUIDANCE AND CONTROL FIN

[75] Inventor: William M. Moscrip, King George County, Va.

[73] Assignee: The United States of America as represented by the Secretary of the Navy, Washington, D.C.

[21] Appl. No.: 641,116

[22] Filed: Dec. 16, 1975

[51] Int. Cl.[5] ..... F42B 10/64

[52] U.S. Cl. ..... 244/3.21; 244/3.24

[58] Field of Search ..... 244/3.21, 3.24

[56] References Cited

U.S. PATENT DOCUMENTS 3,153,203 6/1964 Halsted ..... 244/3.24
3,403,238 9/1968 Buchler et al. ..... 337/393

FOREIGN PATENT DOCUMENTS 1116158 6/1968 United Kingdom ..... 244/3.21

OTHER PUBLICATIONS

Jackson, C. M. et al., "55-Nitinol—The Alloy With a Memory: Its Physical Metallurgy, Properties, and Applications." NASA-SP 5110, 1972.

*Primary Examiner*—Charles T. Jordan
*Assistant Examiner*—Richard W. Wendtland
*Attorney, Agent, or Firm*—John D. Lewis; Kenneth E. Walden

[57] ABSTRACT

A hollow fin of rhombical cross-section constructed of Nitinol or other memory effect alloy and mounted for oscillation about an internal shaft. The memory effect alloy has been previously stretched at a temperature below its critical transition temperature whereby heating of one pair of opposite sides, in a rhombic sense, above the critical transition temperature by resistive dissipation of an electric current will cause shortening of this pair of sides and consequent change in the angle of attack.

7 Claims, 1 Drawing Sheet

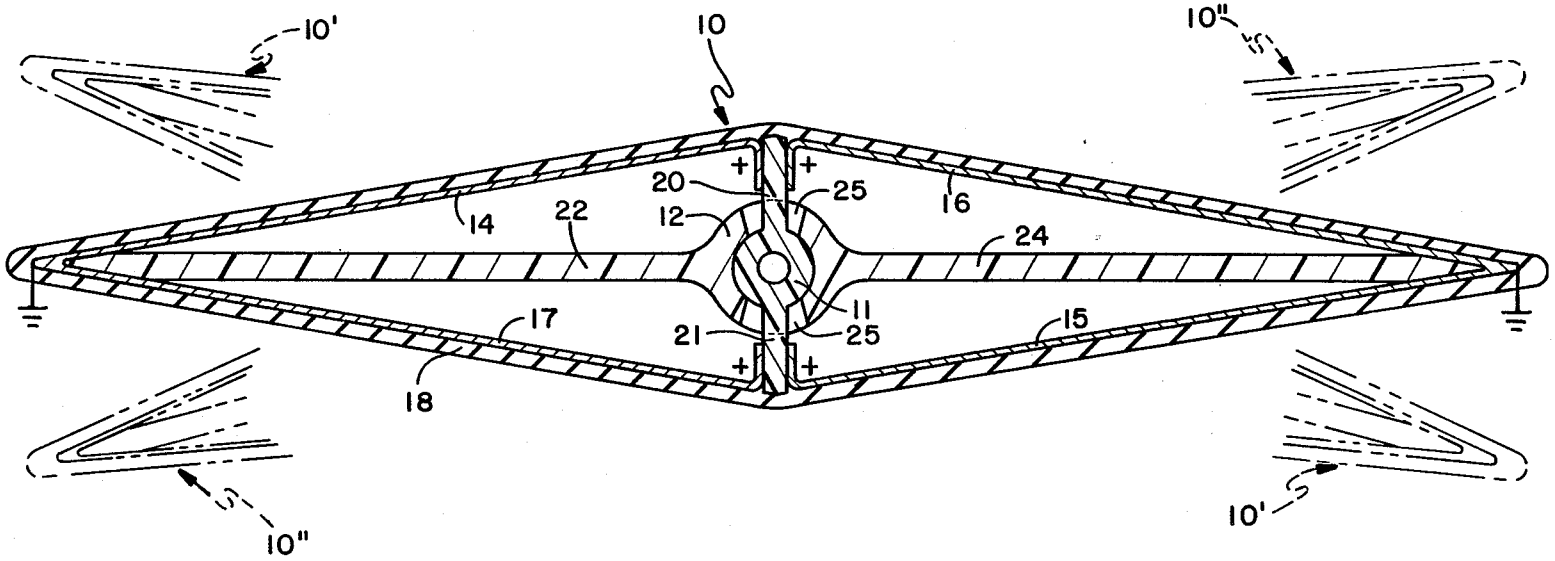
10
10'
10"
10'
10"
11
11
12
14
15
16
17
18
20
21
22
24
25
25

GUIDANCE AND CONTROL FIN

BACKGROUND OF THE INVENTION

This invention relates generally to controllable fins for vehicles operable in a fluid medium and more particularly to a self-actuating controllable fin which requires no external mechanical hardware.

The path of conventional guided missiles, guided projectiles, torpedos, submarines and the like is usually controlled by mechanically changing the angle of attack of a set of shaft-mounted metal fins in response to a servo-control signal generated by the vehicle's guidance and control system. In this manner aerodynamic or hydrodynamic lift is obtained which provides the forces necessary to alter the path of the vehicle as desired. In order to achieve maximum agility in a high speed vehicle the utilization of sophisticated, costly, and complex electrohydraulic servo-actuators is most often prescribed.

The modern guided projectile, which must be launched at high velocity from a gun barrel, is severely volume and weight limited as compared to a guided missile. The chief objective of any guided projectile is to critically damage the target, but as more volume is taken up by seeker and fuze, guidance and control assemblies, rocket motor, etc. there is less volume available for the warhead. This imposes a critical constraint on the design and placement of control surfaces and their associated actuator subassemblies.

For example, current guided projectiles employ rocket propulsion to maintain velocity and enhance maneuverability during the terminal portion of the trajectory. Folding tailfins are used for aeroballistic stability, and forward canard fins are employed for guidance and control. From the standpoint of economy and design simplicity it would be desirable to have the rear stabilizing fins also function as the guidance and control surfaces. But this approach is not technically feasible with current technology because there is not enough room available in the rear portion of the projectile to accommodate both the rocket motor and fin actuation components.

SUMMARY OF THE INVENTION

This invention is a design for the construction of a steerable vehicle guidance and control fin which utilizes the unique physical and mechanical properties of the so-called memory effect alloys, such as the alloy known as Nitinol. The design principles established by this invention are intended to provide a self-actuating, electromechanical, servo-controlled fin which has minimal weight and volume and does not encumber the interior regions of the guided vehicle to which it is attached. The angle of attack of this fin can be changed automatically in response to an electric current which is dissipated resistively within the body of the fin. Thus precise guidance and control of the vehicle is achieved without requiring the use of any mechanical hardware other than the fin itself.

BRIEF DESCRIPTION OF THE DRAWING

The single FIGURE of the drawing is a cross-sectional view illustrating the principles of construction of the fin of the present invention and showing in dotted lines the positions assumed by the fin after control actuation.

DESCRIPTION OF THE PREFERRED EMBODIMENT

The guidance and control fin of the present invention is an electromechanical self-actuating fin which is capable of automatically changing its angle of attack in direct response to a pulse width modulated DC control current which is dissipated resistively through a Nitinol (or other memory effect alloy) structural member.

The Nitinol alloys were developed at the U.S. Naval Ordnance Laboratory during the 1960's. They are nickel-titanium alloys based upon the ductile intermetallic compound TiNi. Nominal 55-Nitinol (55% nickel, 45% titanium by weight) is nearly stoichiometric TiNi, with a density of 0.22304 pounds per cubic inch and a melting point of 1310° C. Nominal 55-Nitinol has an ultimate tensile strength of 125,000 psi and a modulus of elasticity of $12.0\times10^6$ psi.

Nominal 55-Nitinol, in addition to being single phase and ductile, exhibits a very unusual property in the form of a "mechanical memory" which is a function of the temperature and strain history of the material. The "mechanical memory" of Nitinol is attributed to a unique second order martensitic chrystalline phase transformation which occurs across a critical transition temperature, designated $A_S$. This property enables Nitinol alloys to recover a given shape after having been mechanically distorted at some temperature below $A_S$, by simply heating the material to some temperature above $A_S$.

For example, the critical transition temperature $A_S$ for nominal 55-Nitinol is approximately 60° C. (140° F.). Suppose a sample of this alloy has been cast in the shape of a coffee cup; if we then distort the cup at room temperature by striking it with a hammer, it will revert to its original shape when immersed in boiling water. The amount of strain which can be applied and still result in complete shape recovery is limited, but samples distorted up to 8% have been found to recover with 100% efficiency over a large number of cycles.

Referring now to the drawing, the guidance and control fin is designated generally by the reference numeral 10 and is constructed in the form of a simple double wedge or rhombic airfoil as shown. It consists of essentially the following components: a shaft assembly 11, a rotor 12, the Nitinol actuation surfaces 14,15, 16,17 and a thermal barrier coating 18. The shaft assembly is basically a hollow pin which is rigidly attached to the body of the missile or projectile and serves as the shaft about which the rotor 12 pivots. The shaft has two short arms 20, 21 which are mounted perpendicular to the plane of the fin 10 and provide an electrically isolated attachment point for the Nitinol actuation surfaces 14–17. The electrical isolation of the Nitinol surfaces may be achieved by constructing the shaft assembly of fiberglass epoxy, graphite epoxy, or other suitable composite materials.

The rotor 12 is a stiff hollow cylinder with two long arms 22,24 which extend fore and aft in the plane of the fin 10. The rotor is mounted on and pivots about the shaft assembly 11 within a maximum range of perhaps ±15°. The rotor is slotted at 25 to admit the short arms 20,21 of the shaft assembly as shown, and it is attached to the shaft assembly by means of a set of metal snap rings (not shown). The length of the shaft and the length of the rotor along the pivot axis determine the length of the fin and can be any practicable size. The length of the long arms of the rotor and the short arms of the shaft determine the c/t (chord to thickness) ratio of the fin. The c/t ratio can be varied over a rather large range, but it is inversely proportional to the maximum permissible angle of attack.

The outer surfaces of the basic wedge airfoil are constructed from four sections 14–17 of Nitinol alloy sheet which has been prestretched at least 4% in a direction normal to the pivotal axis of the fin. When these sections are attached to the arms of the rotor and the shaft as shown, they form a double-acting electromechanical servoactuator. When an electric current is allowed to flow through sections 14 and 15, these sections are resistively heated above $A_s$ and they tend to contract along their length with a force in excess of 90,000 psi. This action not only further stretches sections 16 and 17 (which yield around 12,000 psi), it also alters the natural angle of attack of the fin by forcing the rotor to pivot on the shaft assembly until the fin assumes the position shown in dotted lines and designated 10'.

If sections 14 and 15 are allowed to cool below $A_s$ and current is permitted to flow through sections 16 and 17, these sections will in turn be heated above $A_s$ and contract as before, restretching sections 14 and 15, and changing the natural angle of attack of the fin in the opposite direction as shown at 10''. The amount of the change in either direction is completely reversible and can be precisely controlled by varying the amount of electric power dissipated within the Nitinol sections. The time response as well as the power requirement of the fin's electromechanical operation is obviously a function of the rate of heat transfer from the heated sections to the ambient airstream. The thermal barrier coating of 18 material such as silicone rubber is applied to the fin 10 as required to adjust this rate with respect to a given Mach number flight speed and requisite fin maneuverability.

From the foregoing, it will be readily apparent that the aforedescribed invention posesses numerous advantages not found in prior art devices. The principal advantage lies in the capability of providing a precisely variable angle of attack in a fin control surface without requiring complex additional hardware components other than the fin itself. It is therefore possible to construct a movable fin which does not adversely encumber the interior regions of the missile or projectile to which it is attached.

Obviously, many modifications and variations of the present invention, in the light of the above teachings, will immediately suggest themselves to those skilled in the art. For example:

1. A memory effect alloy other than 55-Nitinol may be employed in the construction of the fin, although that material appears to be the best presently available from the standpoint of strength, corrosion resistance, and cost.

2. Slight variations in the details of the design such as points of attachment, shaft geometry, c/t ratio, etc. may be desirable under certain circumstances.

3. The use of wire instead of sheet Nitinol may be more suited to the construction of actuator sections if the highest degree of shape recovery and strength are proved to be necessary.

4. Multiple wires of different Nitinol alloys having different critical temperatures may be used to provide incremental deflections dependent upon current magnitude or selection of current path.

5. Multiple wires of the same Nitinol alloy which have been stretched different amounts to provide incremental deflections dependent upon selection of current path.

6. Filling the internal voids in the fin with a lightweight foamed material to provide structural stiffening.

7. In addition to the precision guidance of missiles and gun launched projectiles in air, the present invention may also prove useful as a hydrofoil in water.

It is therefore to be understood that within the scope of the appended claims, the invention may be practiced otherwise than as specifically described.

What is claimed is:

1. A self-actuating control fin for steerable vehicles operable in a fluid medium comprising:

a shaft formed of electrically insulating material adapted to be rigidly secured to the body of the missile or projectile;

a pair of short arms formed integral with said shaft and projecting therefrom in opposite directions and normal to the plane of the fin;

a hollow rigid rotor encompassing said shaft and mounted for oscillation thereon;

a pair of long arms formed integral with said rotor and projecting therefrom in opposite directions in the plane of the fin; and a plurality of sections of memory effect alloy each fastened to the tip of one shaft arm and one rotor arm to define a fin of rhombical cross-section, said alloy sections having been previously stretched at a temperature below its critical transition temperature whereby resistive dissipation of an electric current in opposite sides, in a rhombic sense, will cause shortening of these sides and consequent deflection of the fin to change its angle of attack.

2. A fin as defined in claim 1 wherein said memory effect alloy is a Nitinol alloy.

3. A fin as defined in claim 2 wherein said Nitinol alloy is 55-Nitinol.

4. A fin as defined in claim 1 wherein the outer surfaces of said alloy sections are coated with a resilient thermal barrier material to limit heat transfer from the alloy sections to the ambient fluid.

5. A fin as defined in claim 4 wherein said thermal barrier material is silicone rubber.

6. A fin as defined in claim 5 wherein said memory effect alloy is a Nitinol alloy.

7. A fin as defined in claim 6 wherein said Nitinol alloy is 55-Nitinol.

* * * * *